US009468587B2

(12) United States Patent
Lanier et al.

(10) Patent No.: US 9,468,587 B2
(45) Date of Patent: Oct. 18, 2016

(54) TRAY AND PACKAGING FOR MEDICAL CONTAINERS

(75) Inventors: Romain Lanier, Veurey-Voroize (FR); Adrien Plouvier, St. Martin D'Heres (FR); Charles Biancon, Monestier de Clermont (FR); Franck Carrel, Le Pont de Claix (FR)

(73) Assignee: Becton Dickinson France, Le Pont de Claix (FR)

( * ) Notice: Subject to any disclaimer, the term of this patent is extended or adjusted under 35 U.S.C. 154(b) by 109 days.

(21) Appl. No.: 14/343,957

(22) PCT Filed: Sep. 7, 2012

(86) PCT No.: PCT/EP2012/067573

§ 371 (c)(1),
(2), (4) Date: Jul. 1, 2014

(87) PCT Pub. No.: WO2013/034737

PCT Pub. Date: Mar. 14, 2013

(65) Prior Publication Data

US 2014/0374414 A1 Dec. 25, 2014

(30) Foreign Application Priority Data

Sep. 9, 2011 (EP) ..... 11306122

(51) Int. Cl.

*B65D 25/10* (2006.01)
*A61J 1/16* (2006.01)
*B65D 77/00* (2006.01)
(Continued)

(52) U.S. Cl.

CPC ..... *A61J 1/16* (2013.01); *B65D 25/107* (2013.01); *B65D 77/003* (2013.01); *B65D 77/02* (2013.01); *B65D 81/133* (2013.01); *B65B 5/068* (2013.01); *B65D 2577/047* (2013.01)

(58) Field of Classification Search

CPC ..... A61J 1/16; B65B 5/068; B65D 25/107; B65D 77/003; B65D 77/02; B65D 81/133; B65D 2577/047; B65D 25/10
USPC ..... 206/366, 370, 438, 443, 526, 561–564; 211/74

See application file for complete search history.

(56) References Cited

U.S. PATENT DOCUMENTS 3,509,993 A * 5/1970 Michel ..... B65D 85/324 206/564
3,589,511 A 6/1971 Britt
(Continued)

FOREIGN PATENT DOCUMENTS

| | | |
|---|---|---|
| CN | 201566966 U | 9/2010 |
| EP | 0790063 A1 | 8/1997 |
| FR | 2771390 A1 | 5/1999 |

*Primary Examiner* — Bryon Gehman
(74) *Attorney, Agent, or Firm* — The Webb Law Firm

(57) ABSTRACT

A tray for holding medical containers, including a plurality of elongated parallel cavities that are intended to receive at least one container is disclosed. Each of the cavities includes a first set of contact surfaces for holding the at least one container, and each of the cavities includes a second set of contact surfaces for holding the at least one container when provided with a cap. The first set of contact surfaces and the second set of contact surfaces are arranged such that the at least one capped container is held in the cavity in a reverse orientation with respect to the at least one container when provided without a cap. A packaging for medial containers and a method for packaging medical containers are also provided herein.

14 Claims, 4 Drawing Sheets

(51) Int. Cl.

| | |
|---|---|
| ***B65D 77/02*** | (2006.01) |
| ***B65D 81/133*** | (2006.01) |
| *B65B 5/06* | (2006.01) |

(56) References Cited

U.S. PATENT DOCUMENTS 3,747,751 A * 7/1973 Miller ..... B65D 25/04 206/564
4,645,079 A * 2/1987 Hill ..... B65D 1/36 206/370
6,216,885 B1 * 4/2001 Guillaume ..... A61M 5/008 206/366
8,100,263 B2 * 1/2012 Vanderbush ..... A61M 5/002 206/438
8,142,740 B2 * 3/2012 Self ..... B01L 9/06 206/564
8,360,238 B2 * 1/2013 Nicoletti ..... B65D 5/503 206/443
2006/0054532 A1 3/2006 Ochi
2006/0283773 A1 * 12/2006 Ho ..... H01L 21/67333 206/564
2008/0197037 A1 8/2008 O'Brien et al.

* cited by examiner

TRAY AND PACKAGING FOR MEDICAL CONTAINERS

BACKGROUND OF THE INVENTION

1. Field of the Invention

The present invention relates to a tray and a packaging for medical containers and a process for packaging medical containers.

2. Description of the Related Art

Medical containers that are prefilled with a medicine are a promising way of delivering medicine to patients.

Indeed, such kind of primary packaging requires no or little manipulation of the medicine by the healthcare workers or by the patient before injection thereof.

It is thus particularly advantageous in terms of hygiene, potential contamination and ease of use of the container.

As opposed to the foregoing, non-prefilled containers imply a tedious manipulation from the healthcare workers or by the patient, since he has to take an empty syringe, fill it by himself with a medicine contained in a vial or a similar kind of reservoir and finally withdraw bubbles from the container, before being able to inject the medicine.

However, prefilling medical containers, such as cartridges and/or syringes and/or vials raises several technical problems in the pharmaceutical industry.

Of course, the empty container has to be kept sterile until its filling, and the filling step must be carried out in aseptic conditions.

Besides, for an industrial filling process, it is necessary to provide automated machines to pick up an empty container, fill it with the medicine and then close it.

To that end, in some cases the container has an external shape (e.g. a peripheral flange) appropriate to be manipulated by a robot. In particular, packagings comprising nested containers placed vertically in a tub (i.e. extending perpendicularly to the bottom of the tub) are already used in pharmaceutical plants.

Such a packaging is shown on FIG. 1.

This packaging comprises a tub 1 that contains a nest 9 that is substantially parallel to the bottom of the tub and that lays on a peripheral flange 19 of the tub.

The nest 9 receives and supports the containers 2 in a vertical position.

When the packaging is delivered to the pharmaceutical filling plant, the tub 1 is typically closed by a sealed sheet of porous material and contained in a sealed plastic bag (not shown here) that ensures that the empty containers 2 are not contaminated during transportation and storage.

Before filling, the tub 1 is opened in an aseptic environment, the nest 9 full of containers 2 is taken out from the tub 1 and the containers 2 are lifted up and taken into a centering plate (which is an apparatus used to re-align all the containers at the same time in order to properly insert the stoppers simultaneously into said containers), but still being partly in the nest 9 and held during the filling.

Additionally, such tub 1 is not appropriate once the containers have been capped (e.g. after having been filled). Indeed, the space required by capped containers is greater that the one when they are non-capped and therefore the initial tub cannot be used with capped containers.

Moreover when the containers are made of plastics, the centering plate may generate scratches and particles onto the containers.

Particles have to be avoided because they may contaminate the surroundings of the containers and provide a support for microbiological contamination.

Scratches may negatively alter the aspect of the containers. In addition to the aesthetical deficiency, the presence of scratches on the containers may induce false rejections during the final inspection process after the filling step, which may lead to high scrap rates and consequently increased manufacturing costs.

Besides, lifting and centering a single container from a plurality of nested containers is difficult since the centering plate may not have enough room to easily access a single container.

U.S. Pat. No. 3,589,511 provides a tray wherein medical containers are arranged in a horizontal position, i.e. parallel to the bottom of the tub.

Said tray comprises a plurality of elongated cavities, each one designed to receive a container.

One drawback of such a tray is that the bottom walls and sidewalls of the cavities of the tray are in contact along the whole length of the containers, resulting in scratches on said containers. Therefore, such a tray is not suitable for scratch-sensitive objects.

Besides, said tray can be used to store only uncapped containers but the cavities cannot receive capped containers that are more bulky.

In addition, said tray is designed for manual handling of the trays and the containers by an operator, and is not adapted to an automated process.

One goal of the invention is thus to provide a packaging for medical containers that allows a quick automatic loading and unloading of the containers.

Another goal of the invention is to design a packaging that maximizes the quantity of containers stored in the packaging (such as tub) without causing damage to the containers.

Another goal of the invention is to define a packaging that cooperates with a loading and unloading system that is not likely to deteriorate the containers, that can be used regardless of the external shape of the containers (whether capped or not), and that enables a high production speed.

BRIEF DESCRIPTION OF THE INVENTION

Summary of the Invention

One embodiment of the invention concerns a tray for medical containers,comprising a plurality of elongated parallel cavities that are intended to receive at least one container, characterized in that each of said cavities comprises a first set of contact surfaces for holding said at least one container, and each of said cavities comprises a second set of contact surfaces for holding said at least one container when provided with a cap, said contact surfaces being arranged such that said at least one capped container is held in the cavity in a reverse orientation with respect to said at least one container.

Such a tray provides a limited contact between the containers and the cavities in which they are held, so as to avoid scratches on the containers and to limit the risk of scratches on zones of the containers that are less submitted to aesthetical constraints.

Indeed, the containers are advantageously in contact with the tray only at the contact surfaces of the cavities.

Preferably, the surface of the containers in contact with the tray is preferably of less than 10% of the surface of the containers.

According to a preferred embodiment of the invention, said medical containers are prefillable containers.

Besides, the contact surfaces of the cavities are adapted to avoid clamping force onto the container.

According to a preferred embodiment of the invention, said medical containers are laying horizontally into the tray.

Advantageously, the first set of contact surfaces comprises a first contact surface for holding a first end of a container and a second contact surface for holding a second end of said container, said first contact surface and second contact surface being separated by a recessed portion.

Similarly, the second set of contact surfaces comprises a first additional contact surface for holding the first end of a capped container and a second additional contact surface for holding the second, capped end of a capped container, said first additional contact surface and second additional contact surface being separated by said recessed portion.

In an advantageous embodiment of the invention, the tray further comprises at least three stacking pillars for stacking said tray onto other similar trays, wherein the load of the tray is distributed on said stacking pillars and the height of said stacking pillars is defined such as a container held in a cavity of said tray is not in contact with another tray stacked onto said tray.

In an advantageous embodiment of the invention, the tray further comprises at least one plane surface to be held by a suction device.

In an advantageous embodiment of the invention, the tray comprises at least one detection feature to be detected by a detection device in order to determine the positioning of the containers into the tray.

In an advantageous embodiment of the invention, the tray comprises at least one reinforcing rib aimed at stiffening the tray to avoid bending of the tray when the tray is full of containers.

In an advantageous embodiment of the invention, the tray comprises separating walls to separate each cavity from the other cavities, wherein the height of said walls is chosen such that the distance between the top of said walls and a tray stacked onto said tray is smaller than the diameter of the container.

Another embodiment of the invention concerns a packaging for medical containers characterized in that it comprises:

a tub having a bottom and peripheral walls, a plurality of stacked trays as described above, arranged within the tub, parallel to the bottom of the tub, for holding a plurality of medical containers arranged in the cavities of the trays, a lid on top of the stacked trays for closing the tub, and a sealing element that hermetically closes the tub.

Such a packaging is suited to automated loading and unloading process.

According to an advantageous embodiment of the invention, the lid comprises a peripheral wall fitted into the peripheral wall of the tub so as to maintain the stacked trays in a central position with respect to the tub, said peripheral wall comprising centering elements in contact with the walls of the tub.

Besides, the packaging may comprise a bag sealed around the sealed tub, said bag being under vacuum.

A further embodiment of the invention is a process for packaging medical containers characterized in that it comprises the steps of:

providing a tub, arranging a first tray as described above at the bottom of the tub, the cavities of said first tray holding containers, arranging at least a second similar tray on said first tray, the cavities of said second tray holding containers, and arranging a lid within the tub on top of the upper tray, sealing the tub with a sealing element.

Such process can be automated and carried out with suction devices that allow avoiding scratches on the containers.

BRIEF DESCRIPTION OF THE DRAWINGS

Other features and advantages of the invention will become apparent from the detailed description to follow, with reference to the appended drawings, in which.

DETAILED DESCRIPTION OF THE INVENTION

Figure 1:
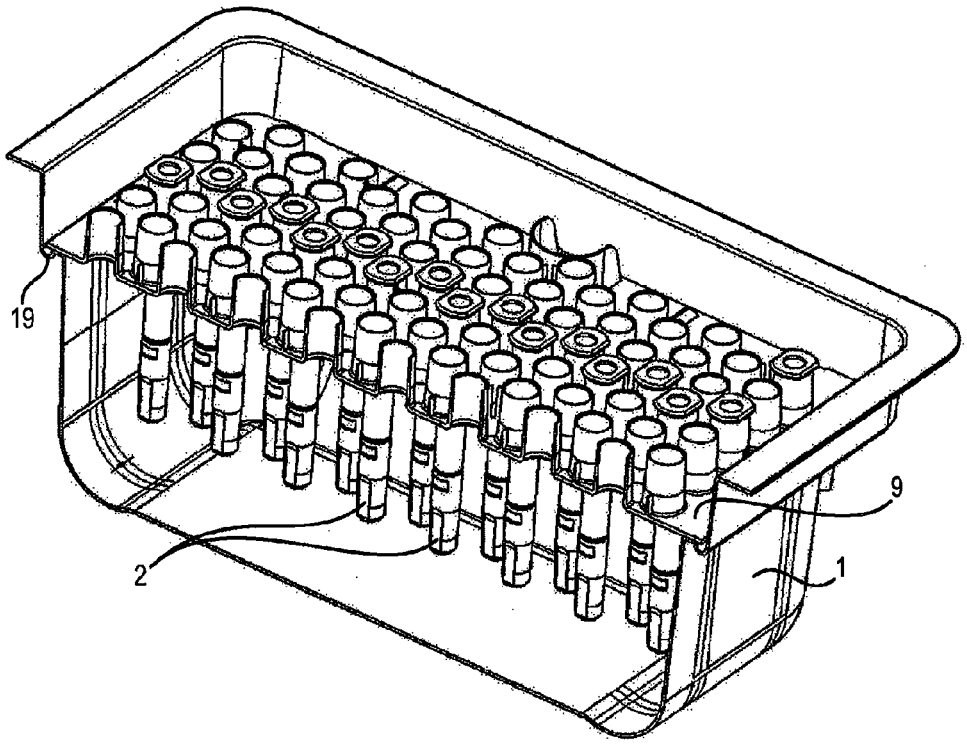
FIG. 1 PRIOR ART
FIG. 1 is a partial perspective view of a known type of packaging.
Figure 2:
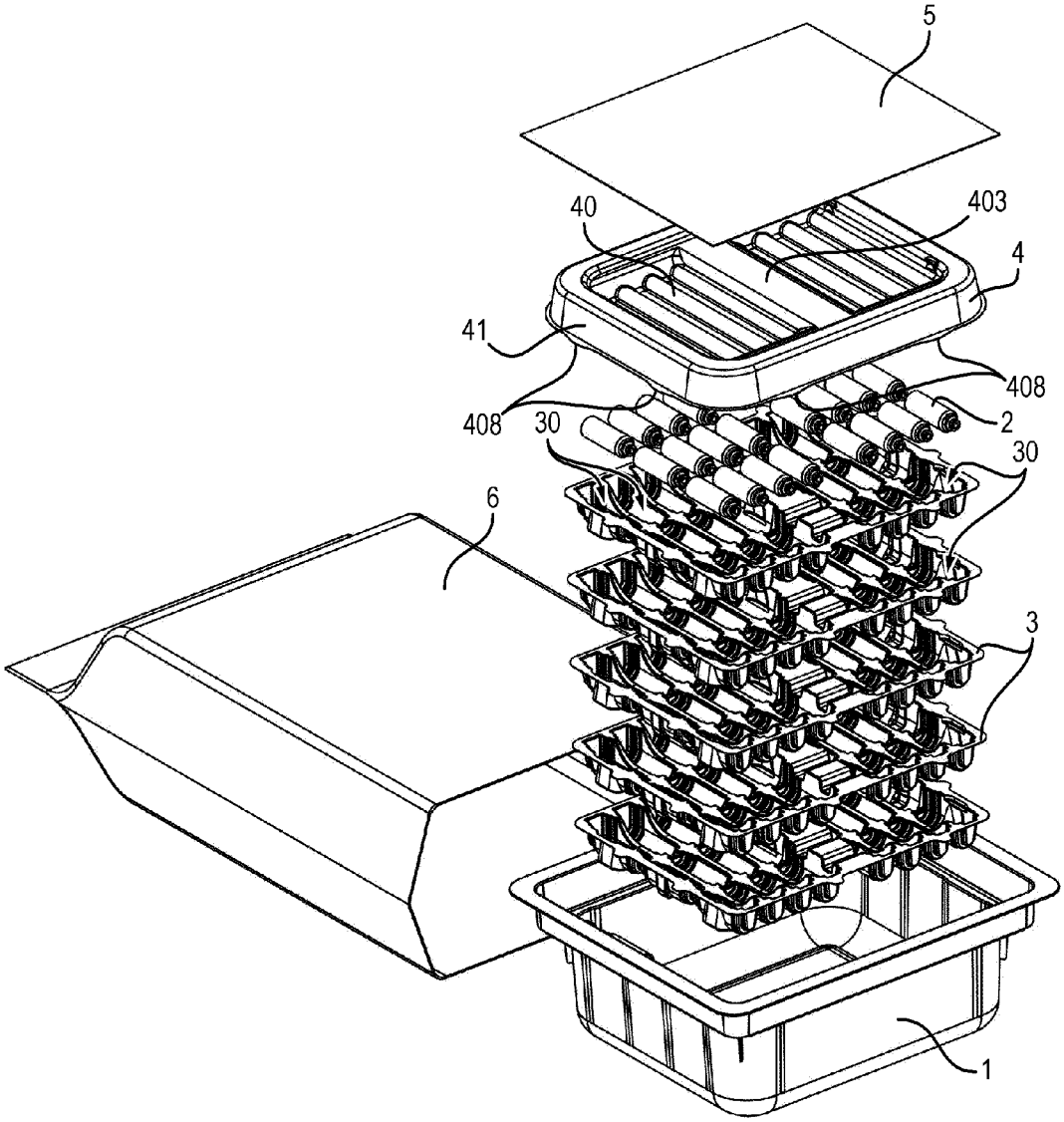
FIG. 2 is an exploded view of a packaging according to an embodiment of the invention.

FIG. 2 is an exploded view showing the elements that compose a packaging for medical containers according to the invention.

In view of the medical use of the containers, all the elements of the packaging are typically sterile.

Containers

The containers are typically hollow elements that present an elongated shape in a direction that is referred to as the longitudinal axis of the containers.

Figure 3A:
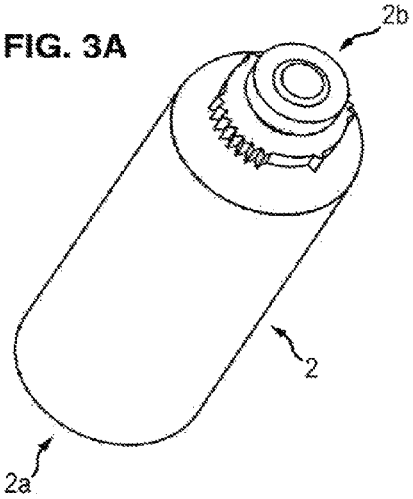
FIG. 3A is perspective view of an embodiment of a non-capped medical container.

FIG. 3A shows an example of such non-capped container.

The containers 2 usually have a cylindrical shape.

The containers 2 have a first end 2*a* intended to receive a stopper (e.g a cartridge or a syringe) that seals the container when it is filled with the medicine, and a second end 2*b* that is intended to receive a needle or another device that will allow injecting the medicine in the body of the user. Further, this container 2 can be filled or unfilled and can also have a bottom at its first end 2*a* rather than being closed by a stopper (e.g. it could be a vial).

Preferably, said medical containers are prefillable.

By "prefillable" is meant in the present text that the containers 2 are empty and have their first end 2*a* opened or closed by a stopper, whereas the second end 2*b* may be sealed or not, and that the containers are adapted to be filled by one of the first or second end which is opened. After filling, the second end of the containers is usually capped.

In a preferred embodiment of the invention, the containers 2 are made of plastics, e.g. cyclo-olefins polymers or copolymers, which are compatible with the medicine they are intended to contain.

Figure 3B:
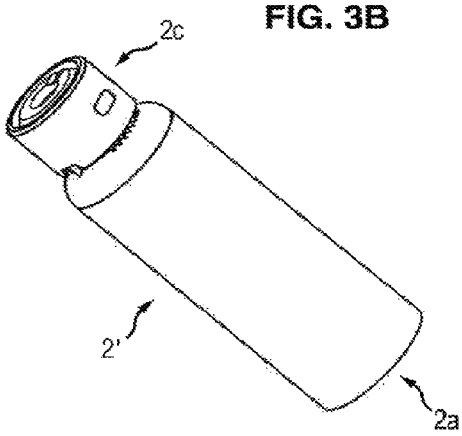
FIG. 3B is a perspective view of an embodiment of the medical container of FIG. 3A having a cap disposed therewith.

FIG. 3B shows a container 2' similar to the container 2 of FIG. 3A but in a capped state. In this case, the second end 2*b* is covered by a cap 2*c*. Further, this container 2' can be filled or unfilled and can also have a bottom at its first end 2*a* rather than being closed by a stopper (e.g. it could be a vial).

The presence of the cap 2*c* results in a greater length of the container 2' as compared to the container 2, and in a wider diameter of the capped second end 2*c* as compared to the non-capped second end 2*b*.

In other words, the second end of the capped container 2' is more bulky than the one of the non-capped container 2.

Packaging

Figure 5:
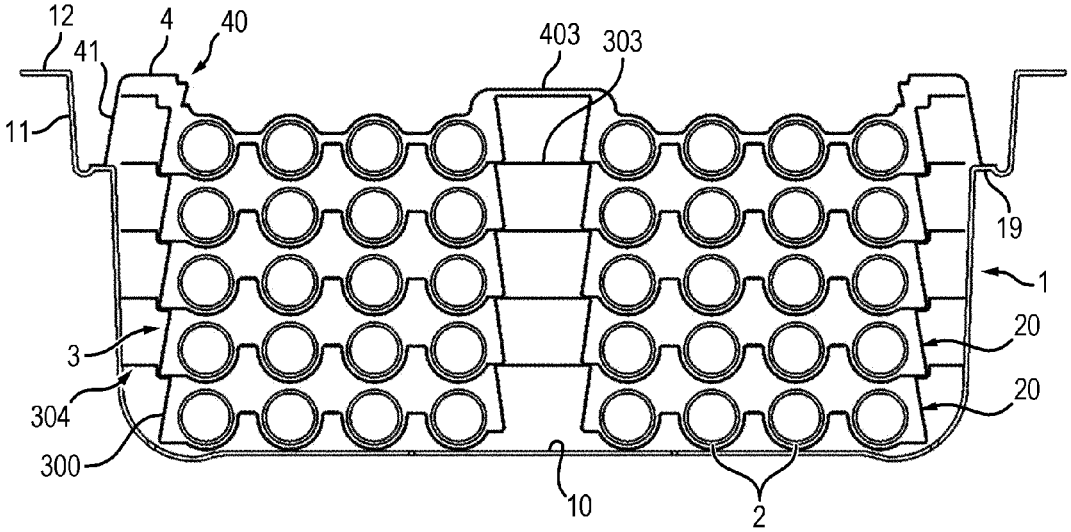
FIG. 5 is a cross-sectional view of a plurality of stacked trays according to an embodiment of the invention.

As shown on FIG. 5, a tub 1 according to the present invention contains medical containers 2 that are arranged so as to form several stacked layers 20 that are parallel to the bottom 10 of the tub 1.

In this respect, the terms "lower" and "upper" designate in the present text something that is respectively "closer" and "farther" from the bottom 10 of the tub.

Besides, "horizontal" designates in the present text something that lies in a plane parallel to the bottom 10 of the tub, whereas "vertical" designates something that is oriented in a direction perpendicular to the bottom 10 of the tub.

Moreover, the terms "longitudinal" and "transversal" designate respectively in the length and in the width of the tub, as the tub of the present invention is described as a parallelepiped.

Each layer 20 is composed of several parallel rows 21 (see FIG. 6) of containers 2, 2', wherein the containers 2, 2' of each row are aligned along their longitudinal axis.

Each layer 20 is contained in a tray 3 that separates each layer from the others.

On top of the upper layer of containers, a lid 4 is arranged so as to close the tub 1 and ensure that the containers do not move during shipping and transportation.

The tub 1 is further hermetically sealed by a sealing element 5, e.g. a sealing sheet that is sealingly fixed to the tub.

When the tub 1 is full of containers 2, 2' and closed by the lid 4, there remains only a limited play of each container 2, 2' with respect to its surroundings, such that the containers 2, 2' cannot leave their position into the tray 3 nor contact other containers 2, 2'.

The sealed tub is further enclosed in a sealed bag 6 as shown on FIG. 2.

Applying a vacuum to the sealed bag 6 enables to pressurize the pile of trays and containers and to immobilize them.

Tub

FIG. 2 presents a tub 1 according to the present invention. The tub 1 is a hollow element in which the containers are arranged.

It has a general parallelepipedic shape, which allows optimizing the number of containers.

The height of the walls 11 of tub 1 depends on the number of layers 20 of containers 2, 2' that the tub 1 is intended to contain.

The length and width of the tub 1 depends on the number of containers 2 placed in each row 21 and on the number of parallel rows 21 that have to be arranged in the tub.

Typically, a tub comprises between 20 and 160 containers, depending on their size.

The tub 1 is usually made of plastic, e.g. polystyrene or polypropylene.

The walls 11 of the tub preferably present an upper edge 12 that is wide enough to allow fixing the above-mentioned sealing element 5 onto the tub, e.g. by welding, in order to guaranty the sterility of the content of the tub.

The bottom 10 of the tub 1 may have a preformed shape but it may also be planar, since, as will be apparent below, the correct positioning of the bottom layer of containers is ensured by the first tray 3 laying at the bottom of the tub.

The tub 1 further comprises a peripheral flange 19 around its entire periphery for receiving the lid 4 in order to close the tub 1 but also to stabilize the stack of the trays 3.

Trays

The trays 3 are designed so that the containers 2, 2' are held but not clamped while they are laying down on the trays.

Besides, the trays 3 are designed so as to avoid any contact between containers, with respect to the adjacent containers 2, 2 of the same row 21 and with respect to the containers 2, 2' of an adjacent row 21.

In addition, in order to avoid scratches on the containers, the contact surface between the tray 3 and each container 2, 2' is minimized and limited to controlled areas of the containers 2, 2' that are less sensitive to scratches.

Figure 6:
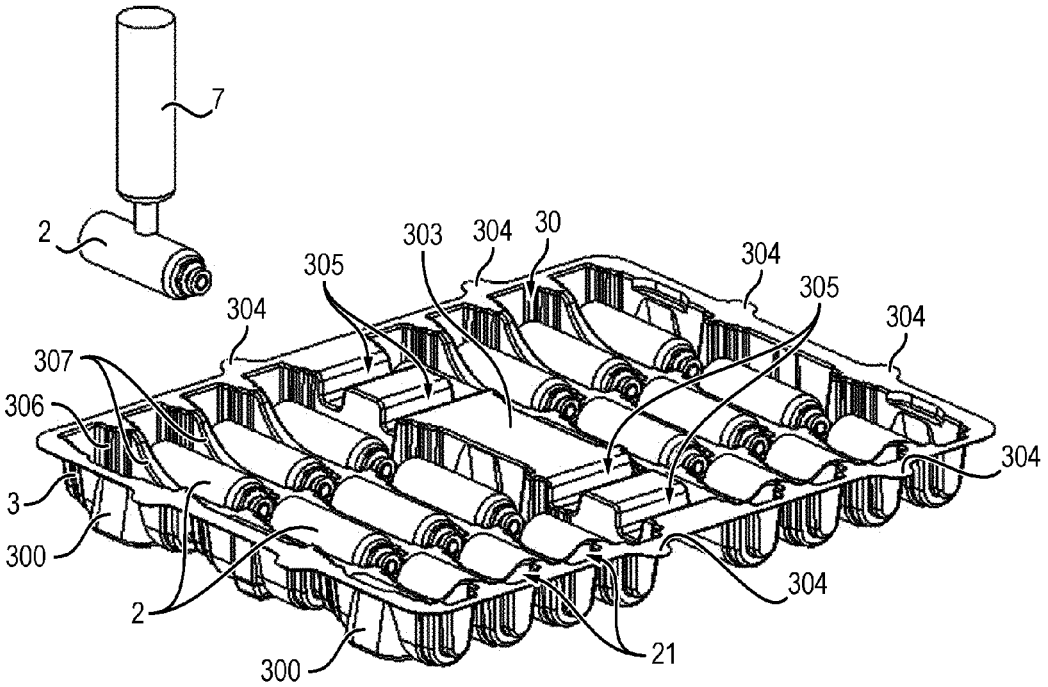
FIG. 6 is a perspective view of a device for loading medical containers from a packaging according to the invention.

To that end, each of the trays 3 comprise a plurality of elongated parallel cavities 30 defined within a surface 308 of the tray 3 and arranged in rows, each cavity 30 being intended to receive a container 2, 2' as shown on FIG. 6.

Each tray 3 supports the above layer 20 of containers while being supported by the tray containing the below layer 20 of containers.

To that end, each tray comprises at least three stacking pillars 300 located at the periphery of the tray.

The stacking pillars 300 are positioned so that the load of the upper tray(s) is distributed on each of said pillars.

In an embodiment not shown, stacking pillars can be added near the center of the tray when the stacked uppers trays are heavy in order to have a better distribution of the upper load.

The height of the stacking pillars 300 is chosen so that they provide enough space between a container contained in the tray and the tray positioned just above, in order to avoid that the container be damaged by the lower face of the upper tray. In another words, the lower face of the upper tray does not contact the containers laying down the lower tray.

In addition, the trays 3 are designed so that they could also be stacked when they do not contain any containers, so as to form a compact stack in view of their handling and storage.

Figure 4A:
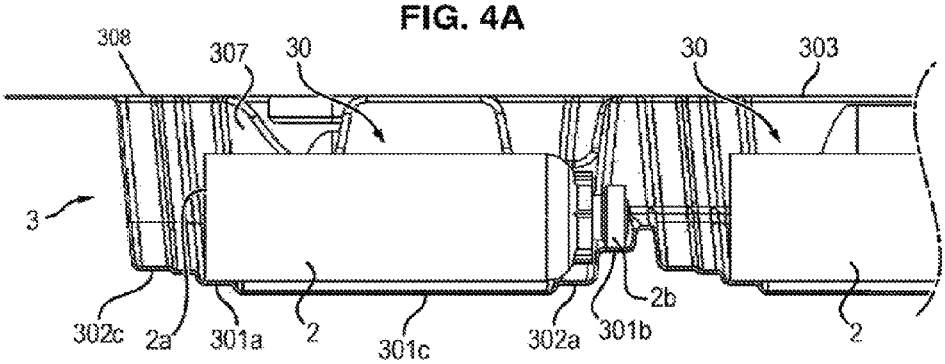
FIG. 4A is a partial sectional view of a plurality of the medical container of FIG. 3A in a tray according to an embodiment of the invention.
Figure 4B:
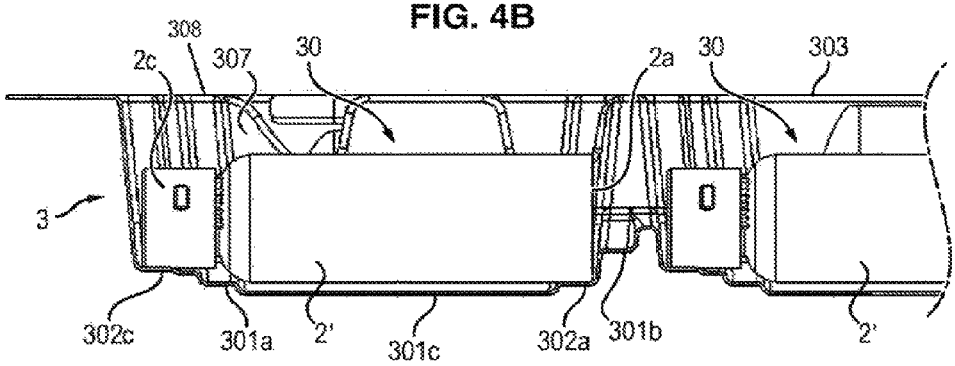
FIG. 4B is a partial sectional view of a plurality of the medical container of FIG. 3B in a tray according to an embodiment of the invention.

FIGS. 4A and 4B are sectional views showing how the containers 2, 2' are placed in a tray 3.

With reference to FIG. 4A, the tray 3 comprises cavities 30 wherein surfaces are arranged to support the containers 2 on dedicated areas thereof.

The first end 2*a* and the second end 2*b* of the container 2 are areas that are less sensitive to scratches because the user does not have to see the medicine through these portions.

Therefore, these portions are chosen to be the portions in contact with the tray 3 since, in the case scratches would be generated on these portions, they would not be detrimental to the aesthetic quality of the container.

Each cavity 30 of the tray 3 thus comprises a first contact surface 301*a* arranged to support the first end 2*a* of the container 2, and a second contact surface 301*b* arranged to support the second end 2*b* of the container 2.

The contact surfaces 301*a* and 301*b* are separated by a recessed portion 301*c* such that the main surface of the container 2 (i.e. the surface of the cylindrical wall on which scratches have to be avoided) is not in contact with the tray 3.

In general, the surface of the container 2 that is in contact with the tray 3 is of less than 10% of the visible surface of the container (by "visible surface" is meant here the surface of the cylindrical wall of the container).

The contact surfaces 301*a* and 301*b* are designed so as to partially surround the first and second ends 2*a* and 2*b* without exerting any effort on them.

The contact surfaces 301*a* and 301*b* are thus curved surfaces with each a radius of curvature that is respectively slightly greater than the radius of the first end and the second end.

Alternatively, the radius of curvature of the surfaces 301*a* and 301*b* could be equal to the radius of the first end 2*a* and second end 2*b* of a container 2, respectively but in such case, it shall not surround the container ends of more than 180°.

In other words, the container 2 merely lays at its ends 2*a*, 2*b* on the contact surfaces 301*a* and 301*b* of the cavity 30 without being secured in the cavity 30 by a clamping force that would be exerted by the contact surfaces 301*a* and 301*b*.

Apart from the first and second contact surfaces 301*a* and 301*b*, the container is not in contact with the tray 3 in which it is placed, nor with the adjacent upper tray.

As explained above, the capped container 2' (see FIG. 3B) is more bulky (in length and width) than the non-capped container 2 in the region of the second end 2*b*, due to the presence of the additional cap 2*c*. Therefore, the capped container 2' does not fit in the same position in the cavity 30 than the non-capped container 2 as it cannot be supported by the first and second contact surfaces 301*a* and 301*b*.

However, it may be very advantageous to use the same tray 3 for an intermediate storage after the filling and/or capping of the containers 2, for example to store the containers 2' in the tray 3 after filling and before packaging them in suitable end-user packages (e.g. individual packages).

Therefore, in a preferred embodiment of the invention, the tray 3 is also designed so as to receive capped containers 2' without damaging them.

The tray 3 contains cavities 30 shaped so as to provide the necessary minimal sufficient play towards containers (2,2').

As shown on FIG. 4B, the capped containers 2' are flipped with respect to the orientation of the containers 2 inside the same tray 3, i.e. the first end of the capped container 2' is positioned at the same side of the cavity 30 than the second end of the non-capped container 2.

To that end, each cavity 30 of the tray 3 comprises, in addition to the above-described contact surfaces 301*a* and 301*b*, additional first and second contact surfaces 302*a* and 302*c*.

The first additional contact surface 302*a* is adapted to support the first end 2*a* of the capped container 2' without exerting any clamping force thereon.

The first additional contact surface 302*a* is a curved surface with a radius of curvature equal to the one of the first contact surface 301*a*.

Alternatively, the radius of curvature of the surface 302*a* could be equal to the radius of the first end 2*a* of a capped container 2' (said first end being usually the same as the first end of a container 2), but in such case, it shall not surround the end 2*a* of more than 180°.

In the embodiment illustrated here, since the diameter of the first end 2*a* of the capped container 2' is greater than the one of the capped end 2*c*, the first additional contact surface 302*a* is located in a lower position in the tray 3 than the second contact surface 302*c*. It is also located more inwards within the cavity 30 than said second contact surface 302*c*.

The second additional contact surface 302*c* is a curved surface with a radius of curvature greater than the one of the second contact surface 301*b* and slightly greater than the radius of the cap 2*c*, so that the cap 2*c* lays on the second additional surface 302*c* without being subjected to any clamping forces.

Alternatively, the radius of curvature of the surface 302*c* could be equal to the radius of the second end 2*c* of a capped container 2', but in such case, it shall not surround the end 2*c* of more than 180°.

In the embodiment illustrated here, since the diameter of the second end 2*c* of the capped container 2' is smaller than the one of the first end 2*a*, the second additional contact surface 302*c* is located in an upper position in the tray 3 than the first contact surface 301*a*. It is also located more outwards within the cavity 30 than said first contact surface 301*a*.

In other words, due to the greater length of the capped container 2' as compared to the one of the container 2, the distance between the first and second additional contact surfaces 302*a*, 302*c* is greater than the distance between the first and second contact surfaces 301*a*, 301*b*.

The contact surfaces 302*a* and 302*c* are separated by the above-mentioned recess 301*c*, such that the main surface of the container 2' (i.e. the surface of the wall on which scratches have to be avoided) is not in contact with the tray 3.

Besides, as shown on FIGS. 4A, 4B and 6, the tray preferably comprises separating walls 307 that separate the cavities 30 from each other.

The height of the separating walls 307 is not necessarily constant, but the separating walls 307 are designed so that the distance between the top of said walls and the bottom of the adjacent upper tray is smaller than the diameter of the containers in both directions in the plane of the tray.

In this way, even if the packaging is subjected to shocks or vibrations during handling, a container 2, 2' cannot leave its cavity 30.

Additionally, these walls 307 give rigidity to the global structure of the tray in order to avoid any bending that could occur when the trays containing containers 2, 2' are transported.

In addition, each cavity 30 presents engagement slopes 306 that correspond to the slope of the cavities that is necessary for the thermoforming process.

Said slopes 306 provide a tolerance in both directions in the plane of the tray with respect to the accuracy of the loading device.

Even if the loading device does not bring the container exactly above the intended cavity 30, the slopes 306 guide the introduction of the container until its appropriate final position on the contact surfaces 301*a*, 301*b*.

In a preferred embodiment of the invention, the tray 3 comprises at least one plane surface adapted to be efficiently contacted by a suction device, such that vacuum can be applied by a suction device.

The diameter of said plane surface is typically of at least 8 mm.

In the embodiment illustrated here, there is only one suction surface 303, which is located in the center of the tray 3. Said suction surface is wide enough to allow application of two adjacent suction devices.

However, the tray could comprise several distinct suction surfaces, provided that they are distributed such that the load of the tray is uniformly distributed, in order to avoid any bending of the tray and possible loss of containers.

For example, the tray could comprise four suction surfaces positioned near the corners of the tray.

The tray 3 is preferably made by thermoforming a plastic sheet e.g. polystyrene or polypropylene or APET (Amorphous Polyethylene Terephthalate).

The material and thickness of the tray are selected so as to provide a sufficient rigidity of the tray. In particular, the tray shall not bend when it is full of containers in order to avoid any loss of containers.

In addition, the tray 3 advantageously comprises reinforcing ribs 305 which cooperate with the thickness and shape of the tray to increase its rigidity.

In the illustrated embodiment on FIG. 6, there are four reinforcing ribs 305 oriented towards the lower face of the tray and oriented lengthwise on either side of the suction surface 303.

However, the skilled person is able to carry out mechanical simulations of the rigidity of the tray and to define suitable reinforcing ribs, depending on the dimensions, thickness and material of the tray.

In order to facilitate the placement of the tray within the tub, the tray 3 advantageously comprises centering elements 304.

Said centering elements 304 are protruding outwards from the edge of the tray 3 in order to contact the inner side of the tub when the tray is placed in the bottom of the tub 1.

In the embodiment illustrated here, said centering elements are semicircular ears distributed along the four edges of the tray 3 but they can of course have other appropriate shapes.

The contact between the ears 304 and the walls of the tub 1 occurs essentially at the first, lowest tray placed inside the tub.

For the trays above the lowest tray, there is a space between the ears 304 and the walls of the tub 1 due to the slope of said walls that is necessary in view of the thermoforming of the tub, and more exactly now to be adapted to a standard tub used in the pharmaceutical industry.

However, the contact between the centering elements 304 and the walls of the tub allows centering the lowest tray 3 within the tub.

The upper trays are centered with respect to the lowest tray due to the stacking pillars 300.

Besides, as mentioned below, the lid 4 also contributes to the centering of the stacked trays within the tub 1.

Advantageously, the centering elements 304 are not symmetrical with respect to at least one axis of symmetry of the tray.

For example, as shown on FIG. 6, the ears 304 are located at the same position on one side of the tray and on the opposite side considering a longitudinal axis while are located in an asymmetric position regarding a transversal axis.

Due to their asymmetric positioning along the transversal axis, the centering elements 304 provide means for detection, i.e. detection features that can be detected by a detection device, e.g. a proximity sensor for having the correct handling of the containers by loading equipments.

The information acquired by the detection device is converted into information about the orientation of the tray with respect to the tub and the loading device and, more precisely, the orientation of the contact surfaces 301*a*, 301*b* or 302*a*, 302*c*.

This information is used by the loading device to bring the containers 2 (respectively, 2') in the suitable orientation into the tray so that the first end 2*a* of the container 2 is received by the first contact surface 301*a* and the second end 2*b* is received by the second contact surface 301*b* (respectively, the first end 2*a* of the container 2' is received by the first additional contact surface 302*a* and the second end 2*c* is received by the second additional contact surface 302*c*).

Similarly, in a step of picking up containers 2 or 2', the information is used by the loading device so that it picks up the containers in a suitable orientation (for example, with the first end 2*a* of the container oriented downwards).

Of course, detection features are not limited to the ears 304 described above; they may consist in at least one feature distinct from the centering elements 304 and adapted to be detected by a proximity sensor or another detection device.

Apart from the centering elements 304, a space remains between the walls of the tub and the peripheral flange of the trays in order to allow insertion of a tool within said space so as to pick up simultaneously a stack of trays. For example, a fork with two arms can be introduced on both inner sides of a tub and pick up a stack of trays.

Lid

When the tub 1 is full of containers, a lid 4 is placed on top of the upper layer 20 of containers so as to close the tub 1.

The lid 4 may be transparent so that a visual inspection is possible, i.e. an operator can visually check the upper layer of containers and their orientation.

Besides, the lid 4 advantageously maintains the pile of trays full of containers in a central position within the tub so as to avoid any movement of the trays in a direction parallel to the bottom of the tub (along both longitudinal and transversal axis) and ensure that the containers do not move during shipping and transportation.

To that end, as shown on FIG. 2, the lid 4 presents a top surface 40 parallel to the bottom 10 of the tub, with external dimensions that are approximately the same as the internal dimensions of the tub 1, and a peripheral wall 41 that is fitted inside the tub 1 in a substantially vertical direction, along the walls 11 of the tub.

The centering of the lid with respect to the tub is provided by centering elements 408.

As shown on FIG. 2, said centering elements may consist in ears protruding from a peripheral flange of the lid 4.

For example, each side of the lid comprises two ears 408.

Advantageously, said ears 408 avoid—or at least minimize—any suction effect due to the contact between the lid 4 and the tub 1.

Indeed, as compared to a situation where the lid would have a wide continuous peripheral flange in contact along the entire length of the corresponding flange of the tub 1, the anti-suction ears 408 provide a smaller contact surface between the lid and the tub and thus minimize a suction effect that could occur when attempting to remove the lid from the tub.

If necessary, the lid could also comprise venting orifices so as to further decrease the suction effect.

Since the packaging is eventually sealed by the sealing element 5, for example, on the upper edge 12 of the tub 1, the presence of said orifices would not be detrimental to the sterility of the containers.

According to a preferred embodiment, the top surface 40 of the lid presents at least one suction surface 403 adapted to be efficiently contacted by a suction device. On FIGS. 2 and 5, the suction surface 403 is located at the center of the lid 4 but it can be located anywhere else on the tray depending on the shape of the tray, which depends on the number of the containers placed into the tray.

Preferably, the suction surface(s) 403 is positioned above the suction surface(s) 303 of the trays 3.

This allows using the same loading device for loading the lid 4 and the trays 3.

In addition, the upper face of the lid 4 is adapted to support a tub placed above it without compression of the lower tub, which provides more stable stacks of tubs.

FIG. 5 is a sectional view of a tub filled with containers 2 and preformed trays 3 and closed by the lid 4.

The peripheral wall 41 of the lid lies on the peripheral flange 19 of the tub 1, this leads to the stabilization of the stacks of the trays.

The height of the peripheral wall 41 is preferably slightly greater than the height of the preformed tray 3, so as to efficiently maintain the upper preformed tray 3 and, as a consequence, all the preformed trays that are stacked under the upper preformed tray.

In addition, the top surface 40 of the lid preferably has a shape that is suited to the rows of containers so that the containers of the upper layer are efficiently maintained between the upper preformed tray 3 and the top 40 of the lid.

Sealing Element

In a preferred embodiment, the sealing element 5 is a sealing sheet, e.g. a Tyvek® sheet that is commonly used in the pharmaceutical industry.

When the tub 1 is full of containers 2 and closed by the lid 4, the sealing sheet 5 is sealed onto the upper edge 12 of the tub 1, so as to keep the containers sterile while being transferred to the filling line.

Vacuum Bag

The sealed tub 1 is contained in a sealed bag 6 in which a vacuum may be created.

Process for Packaging Medical Containers

To create the above packaging, a tub 1 is provided near the machine that manufactures the containers 2.

The manufacturing and packaging steps are carried out in a controlled environment in order to avoid any contamination of the containers.

A first tray 3 is placed at the bottom 10 of the tub.

As mentioned above, this first tray is in contact with the four walls of the tub due to the centering elements 304 located on the periphery of the tray.

The containers 2 are laid down into the first tray so as to form a bottom layer of containers.

According to a preferred embodiment, this is done automatically with a device comprising a plurality of suction devices adapted to load simultaneously a plurality of containers.

Then, a second tray 3 is laid down on this bottom layer, with the cavities of the tray parallel to the rows of containers.

A second layer of containers 2 is then laid down on the tray, and so on until the tub is full of containers.

Then the lid 4 is put onto the tub 1, the sealing sheet 5 is sealed onto the upper edge 12 of the tub 1, and the sealed tub 1 is introduced in a sealed bag 6 in which a vacuum may be created.

Similar steps are carried out to load capped containers 2' in the tub 1, except that the orientation of the capped containers 2' is opposite to the one of the non-capped containers 2.

However, due to the detection feature(s) mentioned above, the loading device is able to detect which is the orientation of the containers (i.e. the first end 2*a* facing or not the loading device) and adapts the loading process accordingly.

FIG. 6 shows a device for loading containers from a packaging according to the invention.

In practice, a plurality of suction cups 7 would simultaneously pick up a full row of containers 2 from a tray 3.

On FIG. 6, only one preformed tray 3 and one layer of containers 2 are shown.

Due to the horizontal arrangement of the containers, a loading device such as a suction cup 7 can easily load each container 2 by its peripheral surface in order to bring it to a filling machine.

As compared to a mechanical loading device, a pneumatic device such as the suction cup 7 does not damage the outer surface of the containers and in particular does not form scratches nor generates particles on the surface of the containers.

Besides, as explained above, the trays 3 and the lid 4 are designed to be loaded by the same kind of pneumatic devices, which simplifies the industrialisation of the filling process.

While specific embodiments of the invention are described with reference to the figures, those skilled in the art may make modifications and alterations to such embodiments without departing from the scope and spirit of the invention. Accordingly, the above detailed description is intended to be illustrative rather than restrictive. The invention is defined by the appended claims, and all changes to the invention that fall within the meaning and range of equivalency of the claims are to be embraced within their scope.

The invention claimed is:

1. A tray for holding medical containers, the tray, comprising a plurality of elongated parallel cavities defined within a planar top surface of the tray, the cavities are each configured to receive a container, the container having a longitudinal axis and configured to be closed by a cap, wherein each of the cavities comprise a first set of contact surfaces for holding the longitudinal axis of the container substantially parallel to the top surface of the tray when the container is not provided with the cap, and each of the cavities comprise a second set of contact surfaces for holding the longitudinal axis of the container substantially parallel to the top surface of the tray when the container is provided with the cap, and wherein the first set of contact surfaces and the second set of contact surfaces are arranged such that when the container is held in the cavity and provided with the cap, the container is held in a reverse orientation with respect to when the container is held in the cavity and the container is not provided with the cap.

2. The tray according to claim 1, wherein the containers are contactable with the tray only at the contact surfaces of the cavities, and an area of a surface of the containers in contact with the tray is less than 10% of the surface of the containers.

3. The tray according to claim 1, wherein the containers are prefillable containers.

4. The tray according to claim 1, wherein the first set of contact surfaces are adapted to avoid clamping force onto the containers.

5. The tray according to claim 1, wherein the first set of contact surfaces comprises a first contact surface for holding a first end of a container and a second contact surface for holding a second end of the container, the first contact surface and second contact surface being separated by a recessed portion, and wherein the second set of contact surfaces comprises a first additional contact surface for holding the first end of a capped container and a second additional contact surface for holding the second, capped end of a capped container, the first additional contact surface and second additional contact surface being separated by said recessed portion.

6. The tray according to claim 1, further comprising at least three stacking pillars for stacking the tray onto other similar trays, wherein a load of the tray is distributed on the stacking pillars and a height of the stacking pillars is defined such that when a container is held in the cavity of the tray, the container is not in contact with another tray stacked onto the tray.

7. The tray according to claim 1, further comprising at least one plane surface to be held by a suction device.

8. The tray according to claim 1, further comprising at least one detection feature to be detected by a detection device in order to determine the positioning of the containers in the tray.

9. The tray according to claim 1, further comprising at least one reinforcing rib that stiffens the tray to avoid bending of the tray when the tray is full of containers.

10. The tray according to claim 1, further comprising separating walls to separate each cavity from other cavities, wherein a height of the walls is chosen such that a distance between a top of the walls and another tray stacked onto the tray is smaller than a diameter of the container.

11. A packaging for medical containers comprising:

a tub having a bottom and peripheral walls;

a plurality of stacked trays arranged within the tub for holding a plurality of medical containers arranged in cavities of the trays;

a lid for closing the tub; and a sealing element that hermetically closes the tub, wherein the plurality of stacked trays each comprise a plurality of elongated parallel cavities defined within a planar top surface of the tray, the cavities are each configured to receive a container, the container having a longitudinal axis and configured to be closed by a cap, wherein each of the cavities comprise a first set of contact surfaces for holding the longitudinal axis of the container substantially parallel to the top surface of the tray when the container is not provided with the cap, and each of the cavities comprise a second set of contact surfaces for holding the longitudinal axis of the container substantially parallel to the top surface of the tray when the container is provided with the cap, and wherein the first set of contact surfaces and the second set of contact surfaces are arranged such that when the container is held in the cavity and provided with the cap, the container is held in a reverse orientation with respect to when the container is held in the cavity and the container is not provided with the cap.

12. The packaging according to claim 11, wherein the lid comprises a peripheral wall fitted into the peripheral wall of the tub so as to maintain the stacked trays in a central position with respect to the tub, the peripheral wall comprising centering elements in contact with the wall of the tub.

13. The packaging according to claim 12, further comprising a bag sealed around the sealed tub, wherein the bag is under vacuum.

14. A method for packaging medical containers comprising:

providing a tub;

arranging a first tray at a bottom of the tub, wherein cavities of said first tray hold containers;

arranging at least a second tray on said first tray, wherein cavities of said second tray hold containers;

arranging a lid within the tub on top of the second tray; and sealing the tub with a sealing element, wherein the first tray and the second tray each comprise a plurality of elongated parallel cavities defined within a planar top surface of the tray, the cavities are each configured to receive a container, the container having a longitudinal axis and configured to be closed by a cap, wherein each of the cavities comprise a first set of contact surfaces for holding the longitudinal axis of the container substantially parallel to the top surface of the tray when the container is not provided with the cap, and each of the cavities comprise a second set of contact surfaces for holding the longitudinal axis of the container substantially parallel to the top surface of the tray when the container is provided with the cap, and wherein the first set of contact surfaces and the second set of contact surfaces are arranged such that when the container is held in the cavity and provided with the cap, the container is held in a reverse orientation with respect to when the container is held in the cavity and the container is not provided with the cap.

* * * * *